United States Patent [19]

Laauwe

[11] 4,262,802

[45] Apr. 21, 1981

[54] PACKAGING AND DISPENSING PILL BOX

[75] Inventor: Robert H. Laauwe, Franklin Lakes, N.J.

[73] Assignee: Essex Chemical Corporation, Clifton, N.J.

[21] Appl. No.: 63,432

[22] Filed: Aug. 3, 1979

[51] Int. Cl.[3] ..... B65D 83/04; B65D 85/56

[52] U.S. Cl. ..... 206/540; 215/224; 220/339; 220/254; 220/281; 222/541

[58] Field of Search ..... 206/540, 528, 493; 220/339, 254, 281, 306; 215/224, 301; 222/541, 543

[56] References Cited

U.S. PATENT DOCUMENTS

| | | | |
|---|---|---|---|
| 3,256,892 | 6/1966 | Esposito, Jr. | 220/339 |
| 3,419,198 | 12/1968 | Pettersen | 222/541 |
| 4,029,202 | 6/1977 | Lasich et al. | 206/493 |
| 4,047,495 | 9/1977 | O'Brian | 215/224 |

*Primary Examiner*—William T. Dixson, Jr.
*Attorney, Agent, or Firm*—Kenyon & Kenyon

[57] ABSTRACT

A molded plastic pill box has a lid hinged by a living hinge at one side of its top so the box can be loaded by a pill manufacturer, the lid when swing closed, permanently locking against reopening. The lid has a pill dispensing opening and a child-resistant closure hinged by a living hinge to the other side of the box top and normally closing the dispensing opening. The box forms a package for the pills and which can be sold by the pill manufacturer to a druggist, an adult purchaser being capable of opening the child-resistant closure for dispensing of the packaged pills. The entire box can be a one-piece molding for minimum cost.

3 Claims, 8 Drawing Figures

Fig. 1.
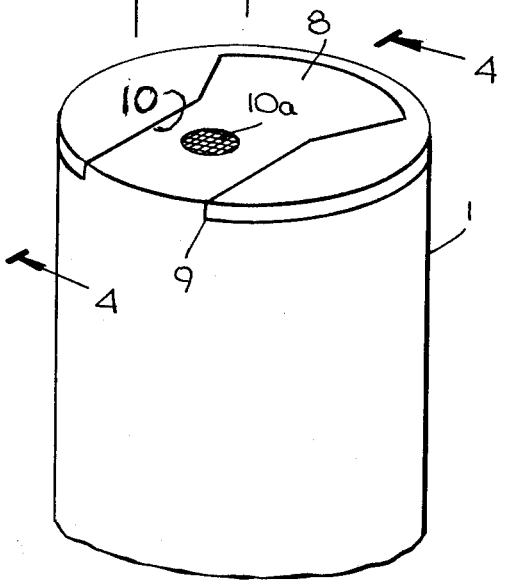
Fig. 2.
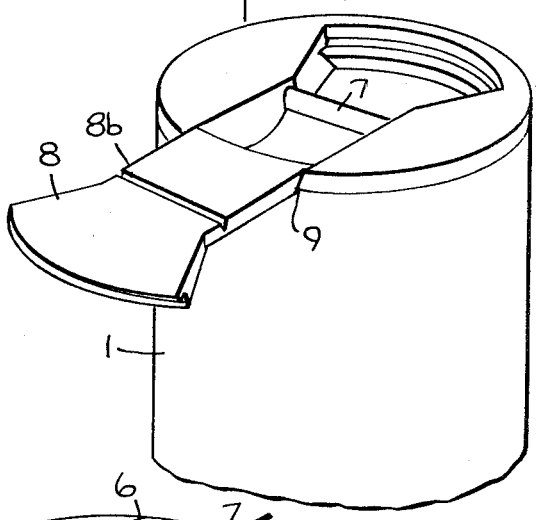
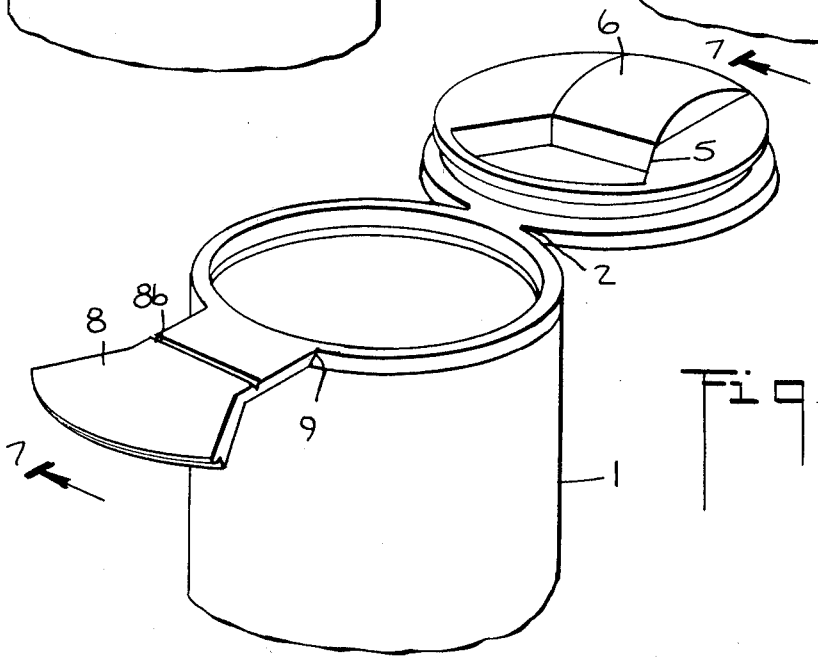
Fig. 3.
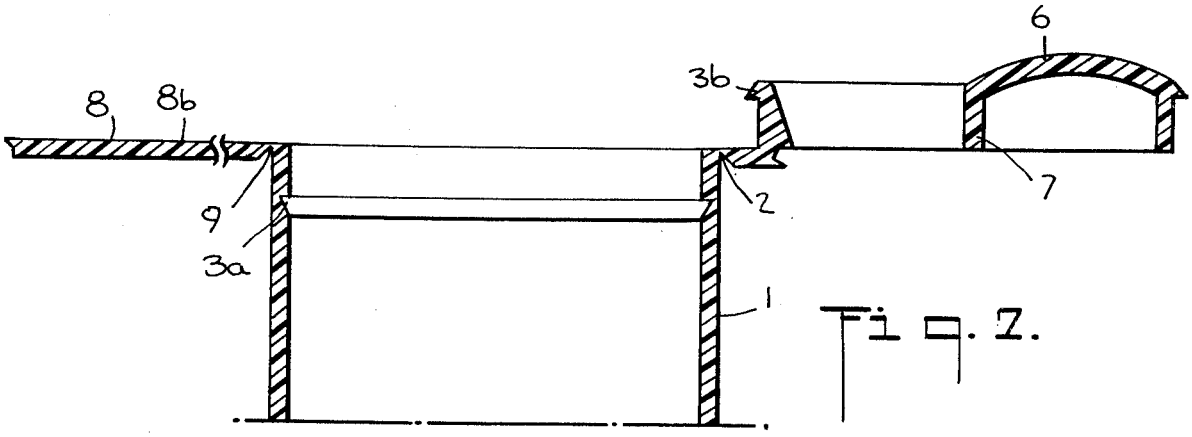
Fig. 7.

PACKAGING AND DISPENSING PILL BOX

BACKGROUND OF THE INVENTION

Today, druggists are increasingly required to sell pills in a box having a child-resistant closure intended to prevent children from opening the box. However, usually the pill manufacturer sells the pills to the druggist in a large container, the druggist removing the required amount of pills and putting them in the pill box and closing it with the child-resistant closure. This involves extra work by the druggist and a chance that the druggist will put pills in the box other than prescribed by the physician.

With some pills, this chance is avoided by the pill manufacturer packaging pills in small quantities in containers provided with a child-proof closure and intended for sale without change to the ultimate user. For example, pills of the aspirin or aspirin substitute types are packaged by the manufacturer and via the druggist sold directly to the user.

Such child-resistant packages normally comprise the pill box, this term bing intended to include bottles, etc., and as a separate part, the child-resistant closure, these being two parts which must be handled by the pill manufacturer, involving an undesirable manufacturing expense. The manufacture of the boxes or bottles and closures comprising the two parts is itself expensive.

There are indications that pill manufacturers will be required to prepackage all pills, this including those sold under doctors' prescriptions, so as to eliminate the druggist's practice of transferring pills from the large manufacturer's container to the small pill boxes when filling the prescriptions, and certainly the resulting packages must be child-resistant or so-called child-proof.

However, heretofore there has not been a completely satisfactory pill box that the pill manufacturer can rapidly load and close, to make packages supplied to the druggist for filling prescriptions and sale, and which is child-resistant.

SUMMARY OF THE INVENTION

To fill the above need, the present invention provides a packaging and dispensing pill box which can be manufactured as a one-piece plastic molding at low cost.

The box has a lid hinged by a living hinge to one side for closing the top and means for locking the lid closed permanently after the lid is once closed. This lid has a pill dispensing opening for use by the ultimate user, and a child-resistant closure hinged by a living hinge to the other side of the box is provided and which can be swung to close this opening after the box is loaded.

Because it can be a one-piece plastic molding, the box is inexpensive to manufacture. The boxes can be loaded one after another by the pill manufacturer, possibly by automated equipment, and after loading, the lid can be swung closed so as to automatically be locked permanently against reopening, and the child-resistant closure then swung into position on top of the lid so as to close the lid's dispensing opening. The chance for the ultimate packages containing improper pills is limited to the pill manufacturer where customarily great precautions against mistakes have prevailed for years.

For the child-proof closure a modification of the cap disclosed by the 1968 Petersen U.S. Pat. No. 3,419,198 is suggested. For this the dispensing opening in the closed permanently locked lid is positioned adjacent to the lid's living hinge so that it is eccentric with respect to the lid and box, and the lid has a depression with a closed bottom between the opening and the hinge on the other side of the box for receiving the child-resistant closure. The lid forms a fulcrum between the depression and opening, positioned so that the closure swings over this depression and fulcrum, the closure having an extending part normally covering the lid's dispensing opening and which part is flexible above the lid's depression and adjacent to the fulcrum. By pressing the closure downwardly into the depression, the extending part normally closing the lid's dispensing opening swings upwardly to an open position for pill dispensing. This swinging end of the child-resistant closure can have a releaseable snap lock with the part of the lid surrounding its dispensing opening.

The lid is provided with a recess into which the child-resistant closure fits when closed, this closure being of less transverse extent than the lid and elongated to substantially span the lid's top. When closed, the closure nests in this recess so that the closure and lid have their top surfaces flush with each other and give no easy visible indication of the closure's presence. This, together with the fact that substantial downward pressure at the right spot on the closure is required to open the closure, should be adequate to make the box meet conventional tests for child resistance.

As previously indicated, the term box is used herein regardless of the actual shape involved. Either cylindrical or rectangular shapes may be used. Moldable plastics are available which are free from any possibility of harmful reaction with prescription or other pills insofar as is known.

To illustrate the principles of this invention, an example is shown by the accompanying drawings and described hereinafter.

BRIEF DESCRIPTION OF THE DRAWINGS

In these drawings, the various views are as follows:

FIG. 1 is a perspective view showing the top of the box as it appears when closed;

FIG. 2 is the same as FIG. 1 but shows the box as the child-resistant closure is opened so the pills can be dispensed for use by the ultimate user;

FIG. 3 is again like FIG. 1 but shows the box with both its closure and lid opened for loading by the pill manufacturer;

FIG. 7 is a vertical section taken on the line VII—VII in FIG. 3; and

DETAILED DESCRIPTION OF THE DRAWINGS

Figure 6:
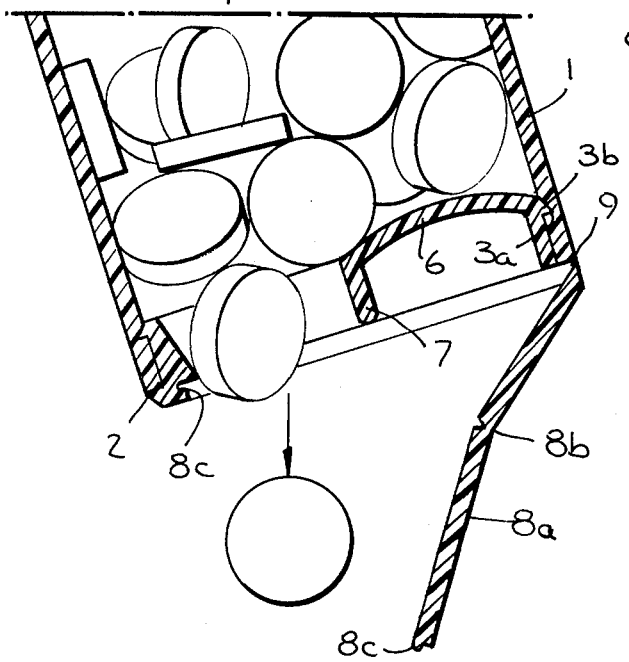
FIG. 6 is like FIGS. 4 and 5 but shows the box inverted with the pills being dispensed.

The above drawings show the box when having a cylindrical side wall 1. A living hinge 2 hinges the lid 3 to the box, this lid having the pill-dispensing opening 4 eccentrically positioned adjacent to the hinge 2 and of adequate size for the passage of the packaged pills as indicated by FIG. 6. Otherwise the lid completely covers the top of the box but prior to pill loading leaving the top completely open as shown by FIGS. 3 and 7. The opening 4 is formed by the lid being molded with a depending skirt 5 which surrounds the opening 4 and also so as to form the depression 6 having the closed bottom as previously described, and being shaped somewhat cup-like. The depression 6 is positioned between the opening 5 and the side of the box opposite to the hinge 2, the skirt 5 and depression 6 defining a mutually common wall 7 which forms a fulcrum for actuation of the child-resistant closure.

The child-resistant closure 8 is hinged by a living hinge 9 on the opposite side of the box from the hinge 2 and this closure, after closing and locking of the lid, swings over the lid so as to nest within a depression 10 and into which the closure fits with its top and all parts of the lid 3 externally flush with each other.

As previously indicated, the lid forms a fulcrum 7 between the depression 6 and the opening for dispensing the pills.

The child-resistant closure, hinged at 9, after closing and locking of the lid, swings over the latter in the form of an elongated shape of less transverse extent than that of the lid. The closure 8 has an extending part **8*a* which normally covers the lid's dispensing opening and is flexible, or has increased flexibility, at 8*b* adjacent to the fulcrum 7 and at a location between this fulcrum and the hinge 9. The part 8*a*, which can be flared as indicated by FIGS. 1 through 3, can have a pressure-releaseable latching action with the lid adjacent to the latter's hinge 2, as indicated at 8*c***. This may comprise a rounded groove formed in the lid and a bead formed on the extending part of the closure, the two parts latching together but the latching parts being transversely rounded in cross section providing a closing with a somewhat snap action and a release with force with a corresponding kind of action.

On the other hand, the lid 3 latches closed via a latch **3*a* of ratchet-tooth configuration. In other words, this lock latches to a closed position and via right angularly related parts 3*b*** cannot be reopened when once pushed to locked position by the pill manufacturer. Once closed, these lid-locking parts are inaccessible from the outside of the box and lid.

Figure 4:
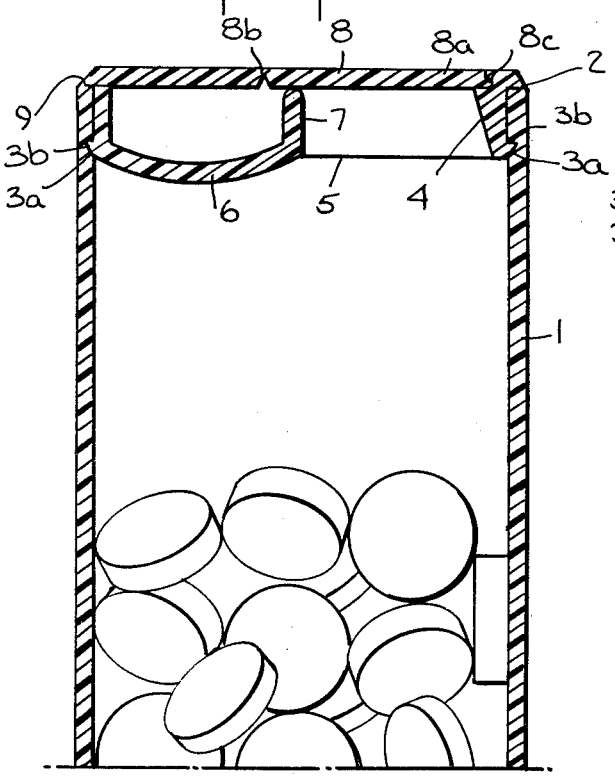
FIG. 4 is a vertical section taken on the line IV—IV in FIG. 1
Figure 5:
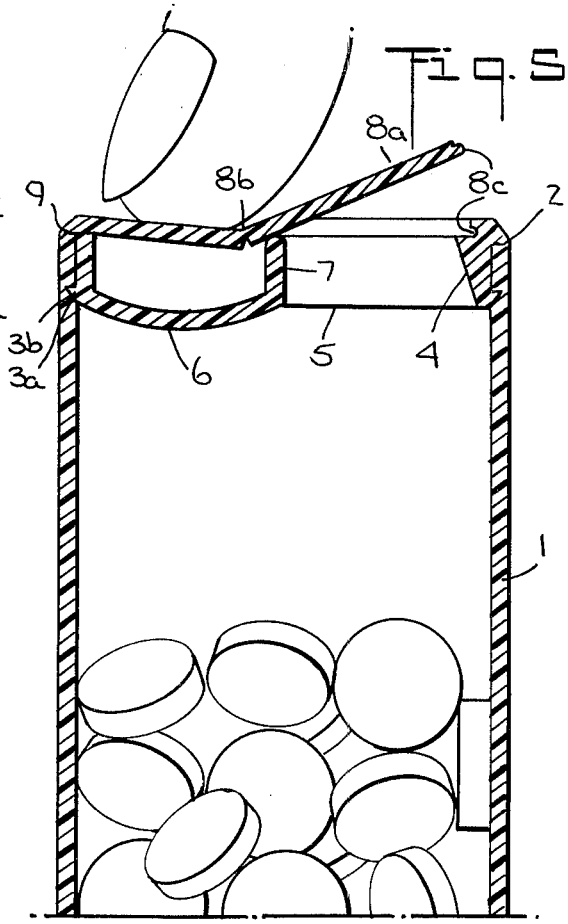
FIG. 5 is like FIG. 4 but shows the action of the child-proof closure when being opened.

As can be seen from FIGS. 1 and 4, the top of the box, when closed for delivery to and sale by the druggist, has all completely flush top parts. The portion of the child-resistant closure between the fulcrum 7 and the living hinge 9 is available for opening of the closure by downward finger pressure of sufficient force, by rocking action via the fulcrum 7, to cause the extending part of the closure 8 to receive an upward swinging force causing its pressure or force releaseable latch **8*c* to release so that the closure's extending part over the lid's dispensing opening swings upwardly as illustrated by FIG. 5**.

The combined effects of the flush top of the pill box, together with the need for appreciable pressure on the closure between the fulcrum 7 and hinge 9, permits the closed box to meet child-resistant tests.

For adult use the pill box top can be provided with an indication of where opening pressure should be applied as is suggested at **10*a* in FIG. 1**.

The entire one-piece, integrated pill box, whether cylindrical or rectangular in shape, can be injection-molded as a single shot using commercially available plastics. The technique of molding living hinges, which are flexible parts of the overall molding, such as shown at 2 and 9, is known to the molding art. With this invention the great numbers of pill boxes which can be expected to be required, can be shipped to the pill manufacturer, at low cost. There the manufacturer normally by automated means can load each pill box with the required prescription and amount normally supplied, swing shut the lid, which automatically locks permanently against ever reopening, and then swing over the child-resistant closure on top of the lid so that this closure nests in the recess in the top of the lid and snaps closed via the force releaseable parts **8*c***. The loading and closure of the pill box can be rapidly performed either by automation or manually. The packages can be shipped to the druggist who receives them with the assurance that he is no longer responsible for filling prescriptions.

For shipment from the injection molder producing the pill boxes, to the pill manufacturer, the lids can be closed and the child-resistant closures overlapped on the lids, if a strip of relatively rigid material is snapped between the periphery of the lid and box when the lid is closed. With this as a starter, the lid can be further wedged open rapidly, something that is impossible in the absence of the strip.

When made as a one-piece or integral molding from any of the currently available plastics, the parts of the box have a certain inherent elasticity permitting the use in a practical manner of the living hinges 2 and 9, the snapping closed and unclosed of the child-resistant closure via the transversely rounded interfitting parts **9*c*, and easy snap-closing of the lid by the pill manufacturer. The plastic elasticity is sufficient to permanently lock closed the lid after closing, assuming the interlock is along the lines as indicated at 3*a* and 3*b* in FIGS. 4 and 5**, in particular.

Figure 8:
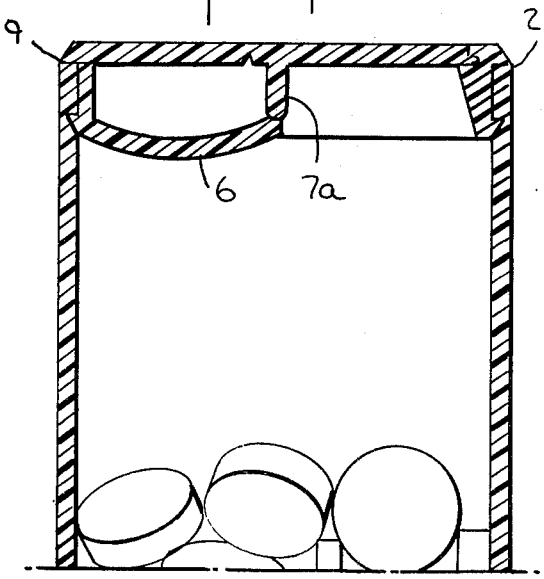
FIG. 8 in vertical section shows a possible modification of the construction shown by FIGS. 4 through 7.

The fulcrum 7 need not be provided by the lid itself. As shown by FIG. 8, the fulcrum **8*a* can depend from the child-resistant closure so as to contact the bottom of the lid's depression 6**.

What is claimed is:

1. A packaging and dispensing pill box having an open top, a lid hinged by a hinge to one side of the box for closing the top, means inaccessible from the outside of the box and lid for locking the lid against reopening after the lid is closed, the lid having a pill dispensing opening, and a child-resistant closure for the opening and which is hinged by a hinge to the other side of the box opposite to said one side.

2. The box of claim 1 in which said dispensing opening is positioned adjacent to the lid's said hinge and the lid has a depression with a closed bottom between the opening and said hinge for the child-resistant closure, means for forming a fulcrum between the depression and opening, said closure swinging over the lid's depression and fulcrum and having an extending part normally covering the opening and being flexible adjacent to the fulcrum so that by pressing the closure into the depression the extending part swings upwardly to free the lid's dispensing opening.

3. The box of claims 1 or 2 in which said box, lid and closure are formed by a one-piece plastic molding and said lid and closure respectively are each hinged by a living hinge of the plastic to the box.

* * * * *